US007718333B2

(12) United States Patent
Nagai et al.

(10) Patent No.: US 7,718,333 B2
(45) Date of Patent: May 18, 2010

(54) ELECTROPHOTOGRAPHIC PHOTOCONDUCTOR AND METHOD OF PREPARING SAME

(75) Inventors: Kazukiyo Nagai, Numazu (JP); Chiaki Tanaka, Tagata-gun (JP); Tetsuro Suzuki, Fuji (JP); Hiroshi Ikuno, Yokohama (JP); Hongguo Li, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/845,830

(22) Filed: Aug. 28, 2007

(65) Prior Publication Data

US 2008/0063959 A1 Mar. 13, 2008

Related U.S. Application Data

(62) Division of application No. 10/458,626, filed on Jun. 11, 2003, now Pat. No. 7,279,260.

(30) Foreign Application Priority Data

| | | |
|---|---|---|
| Jun. 12, 2002 | (JP) | 2002-171921 |
| Jun. 12, 2002 | (JP) | 2002-171954 |
| Jan. 9, 2003 | (JP) | 2003-003709 |
| Jan. 24, 2003 | (JP) | 2003-016661 |

(51) Int. Cl.
*G03G 5/147* (2006.01)
*G03G 5/047* (2006.01)

(52) U.S. Cl. ..... 430/58.2; 430/66; 430/58.7

(58) Field of Classification Search ..... 430/58.2, 430/58.7, 66
See application file for complete search history.

(56) References Cited

U.S. PATENT DOCUMENTS

| | | | |
|---|---|---|---|
| 6,326,112 | B1 | 12/2001 | Tamura et al. |
| 6,432,596 | B2 | 8/2002 | Ikuno et al. |
| 6,444,387 | B2 | 9/2002 | Ri et al. |
| 6,465,648 | B1 | 10/2002 | Tadokoro et al. |
| 6,489,073 | B2 | 12/2002 | Kotsugai et al. |
| 6,492,079 | B2 | 12/2002 | Shimada et al. |
| 6,544,701 | B2 | 4/2003 | Tadokoro et al. |
| 6,548,216 | B2 | 4/2003 | Kawamura et al. |
| 6,576,386 | B1 | 6/2003 | Ri et al. |
| 6,596,449 | B2 | 7/2003 | Shimada et al. |
| 6,625,409 | B2 | 9/2003 | Shakuto et al. |
| 2002/0076631 | A1 | 6/2002 | Itami et al. |
| 2004/0157145 | A1 | 8/2004 | Tokarski et al. |

OTHER PUBLICATIONS

Diamond , Arthur S & David Weiss (eds.) Handbook of Imaging Materials, New York, Marcel-Dekker, Inc. (Nov. 2001), p. 158.

Alger, Mark Polymer Science Dictionary. London: Elsevier Applied Science. (1989) pp. 438-439.

*Primary Examiner*—Christopher RoDee
(74) *Attorney, Agent, or Firm*—Oblon, Spivak, McClelland, Maier & Neustadt, L.L.P.

(57) ABSTRACT

An electrophotographic photoconductor having a layer of a crosslinked resin obtained by reacting an epoxy group-containing amine compound having a charge transferability-imparting group with at least one silicon compound selected from an epoxy ring-free alkoxysilane compound, an epoxy ring-free silanol compound, an epoxy ring-containing alkoxysilane compound and an epoxy ring-containing silanol compound.

9 Claims, 2 Drawing Sheets

ELECTROPHOTOGRAPHIC PHOTOCONDUCTOR AND METHOD OF PREPARING SAME

REFERENCE TO PRIOR APPLICATIONS

This application is a Divisional of U.S. application Ser. No. 10/458,626, filed on Jun. 11, 2003, now allowed. This application claims priority to Japanese Patent Application Nos. 2002-171954, filed Jun. 12, 2002; 2002-171921, filed Jun. 12, 2002; 2003-003709, filed Jan. 9, 2003; 2003-016661, filed Jan. 24, 2003.

BACKGROUND OF THE INVENTION

1. Field of the Invention

This invention relates to an electrophotographic photoconductor for use in image forming machines such as printers, copying machines and facsimile machines. The present invention is also directed to a method of preparing an electrophotographic photoconductor.

2. Description of the Related Art

Recent development of information processing systems using electrophotography is striking. In particular, laser printers and digital copying machines in which information is recorded using light as digital signals have shown significant improvement in image quality and reliability. Further, such an improvement is now coupled with high speed recording technique to provide full color laser printers and full color digital copying machines. In this circumstance, a need exists for an electrophotographic photoconductor which can provide high quality images and which has high durability.

As to an electrophotographic photoconductor for use in laser printers and digital copying machines, the recent trend is toward the use of organic photoconductive materials for reasons of their low costs, good productivity and freedom of pollution. Typical examples of known organic electrophotographic photoconductors include those using a photoconductive resin such as polyvinylcarbazole (PVK), those using a charge transport complex such as 2,4,7-trinitrofluorenone (PVK-TNF), those using a dispersed pigment such as phthalocyanine-binder, and those of a function-separation type using a combination of a charge generation material and a charge transport material. Above all, the function-separation type electrophotographic photoconductor is currently dominant.

The mechanism of forming electrostatic latent images using the function-separation type electrophotographic photoconductor is as follows. First, a surface of the photoconductor is charged and thereafter exposed to light images. The light passes through the charge transport layer and enters the charge generation layer so that a charge generation material contained therein absorbs the light, whereupon a charge carrier is produced from the charge generation material. The charge carrier is injected into the charge transport layer and travels along an electric field generated by the charging step to neutralize the surface charge of the photoconductor. As a result, electrostatic latent images are formed on the surface of the photoconductor.

In general, the organic electrophotographic photoconductors have drawbacks because the surface thereof is apt to be abraded upon repeated use, which causes a reduction of the charge potential and the light sensitivity thereof as well as injuries of the surface thereof, resulting in deterioration of the image quality such as an increase of background stains and a reduction of image density. For this reason, it is one of the important problems to provide an electrophotographic photoconductor having high durability. Recent demand for high speed and compact image forming apparatuses also calls for high durability of the photoconductor. The organic electrophotographic photoconductors have additional drawbacks because cracks are apt to form when foreign matters such as lipids derived from human hands deposit on a surface thereof and when crystallization of the photoconductive material occurs on the deposited area.

To cope with these problems, a method has been proposed in which a protective layer is provided on the top surface layer of the photoconductor. The protective layer may be lubricated, cured, or added with a filler. For example, Japanese Laid-Open Patent Publications No. 07-295248, No. 07-301936 and No. 08-082940 disclose incorporating a fluorine-modified silicone oil into the outermost surface layer of a photoconductor for the purpose of improving surface characteristics such as wear resistance thereof. However, the fluorine-modified silicone oil tends to be lost during repeated use and fails to maintain its effect for a long time.

A proposal has been made to incorporate an inorganic filler or crosslinked resin particles in the outermost layer of an organic electrophotographic photoconductor to improve the abrasion resistance. The use of the filler, however, adversely affects the charging potential and residual potential and causes a problem that the potential greatly varies upon repeated use of the photoconductor.

Also proposed is the use of a thermosetting resin in the outermost layer. In particular, much attention is being paid on a three-dimensionally crosslinked resin containing a charge transferability-imparting skeleton in view of its good electrophotographic properties and good wear resistance. For example, Japanese Laid-Open Patent Publication No. H09-190004 discloses the use of organic silicon-modified positive hole transporting compound in which a silicon compound having a hydrolyzable group is directly introduced into an charge transporting material. Japanese Laid-Open Patent Publication No. 2000-171990 suggests the use of an outermost layer in which a charge transporting compound having a hydroxyl group, an amino group or a thiol group capable of condensing with a silanol group is introduced into a three-dimensionally crosslinked siloxane layer. Japanese Laid-Open Patent Publication No. 2000-206715 proposes the use of a three-dimensionally crosslinked layer obtained from an acrylic compound and a charge transporting material having at least two chain-polymerizable groups.

The electrophotographic photoconductor of Japanese Laid-Open Patent Publication No. H09-190004, however, has a problem that it is difficult to synthesize and purify the organic silicon-modified positive hole transporting compound. An unpurified product causes a reduction in layer strength and adversely affects the electrophotographic properties. The photoconductor of Japanese Laid-Open Patent Publication No. 2000-171990 has drawbacks that the charge transporting compound having incorporated thereinto a reactive group has poor compatibility and the mechanical strength of a layer obtained therefrom are not satisfactory. In the case of the photoconductor of Japanese Laid-Open Patent Publication No. 2000-206715, the residual chain-polymerizable groups adversely affect the resistance to gases and the mechanical strengths of a layer obtained therefrom.

SUMMARY OF THE INVENTION

It is, therefore, an object of the present invention to provide an electrophotographic photoconductor which has solved the above-mentioned drawbacks.

Another object of the present invention is to provide an electrophotographic photoconductor which has high resistance to wear and a long service life and which can give high quality image for a long period of time.

It is a further object of the present invention to provide an electrophotographic photoconductor which has high scratch resistance, which exhibits good chargeability, which has low residual potential after light exposure, which is small in variation of charging potential and residual potential upon repeated use, which can withstand charging hazard and which hardly causes formation of abnormal images.

It is a further object of the present invention to provide a method of fabricating an electrophotographic photoconductor of the above-mentioned type.

In accomplishing the foregoing objects, there is provided in accordance with one aspect of the present invention an electrophotographic photoconductor having a layer comprising a crosslinked resin formed by condensation of silanol groups, and charge transferability-imparting groups each bonded to a silanol group of said resin through an epoxy group.

In another aspect, the present invention provides an electrophotographic photoconductor having a layer comprising a crosslinked resin containing a first chain formed by condensation of silanol groups and a second chain formed by addition of a silanol group to an epoxy group, and charge transferability-imparting groups each bonded to a silanol group of said resin through an epoxy group.

The present invention further provides an electrophotographic photoconductor having a layer comprising a crosslinked silicone resin having —O—$CH_2$—CH($OL^1$)-Z groups bonded to silicon atoms of said resin, wherein Z represents a charge transferability-imparting group and $L^1$ represents a hydrogen atom or a bond connected to a silicon atom of said resin.

The present invention further provides an electrophotographic photoconductor having a layer comprising a crosslinked silicone resin comprising a group of the following formula:

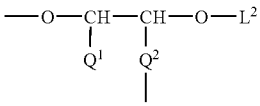

bonded to silicon atoms of said resin, wherein $Q^1$ represents a hydrogen atom and $Q^2$ represents an oxyalkylene group or an alkylene group, or $Q^1$ and $Q^2$ are taken in combination to represent a cycloalkylene group or a cycloalkylenealkylene group and $L^2$ represents a hydrogen atom or a bond connected to a silicon atom of said resin, and —[O—$CH_2$—CH($OL^1$)]$_p$-Z groups bonded to silicon atoms of the resin, wherein Z represents a charge transferability-imparting group, $L^1$ represents a hydrogen atom or a bond connected to a silicon atom of the resin and p is an integer of 1 or more.

The present invention further provides an electrophotographic photoconductor having a layer of a crosslinked resin obtained by reacting an epoxy group-containing amine compound having a charge transferability-imparting group with at least one silicon compound selected from the group consisting of an epoxy ring-free alkoxysilane compound, an epoxy ring-free silanol compound, an epoxy ring-containing alkoxysilane compound and an epoxy ring-containing silanol compound.

The present invention further provides an electrophotographic photoconductor comprising an electrically conductive substrate, a photoconductive layer provided thereon, and a resin layer comprising a crosslinked resin obtained by reacting an epoxy group-containing amine compound with an epoxy ring-free silicon compound selected from the group consisting of an alkoxysilane compound and a silanol compound.

The present invention further provides a method of preparing an electrophotographic photoconductor, comprising the steps of:

providing a coating liquid comprising the following ingredients (a), (b) and (c) dissolved and/or dispersed in a solvent:

(a) a silane compound having at least one hydroxyl group bonded to the silicon atom thereof;

(b) an epoxy group-containing amine compound represented by the following formula (1):

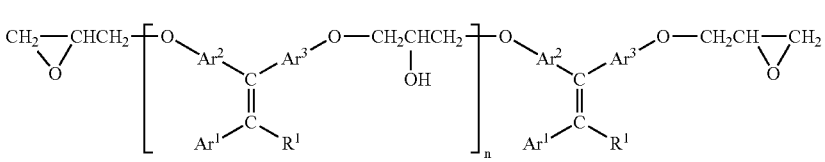

(1)

wherein $R^1$ represents a hydrogen atom, an alkyl group which may have one or more substituents, or an aryl group which may have one or more substituents, $Ar^1$ represents an aryl group having at least one tertiary amino group or a heterocyclic group having at least one tertiary amino group, $Ar^2$ and $Ar^3$ may be the same or different and each represent an arylene group which may have one or more substituents and n is an integer of 0 to 100;

(c) an aluminum chelate compound of the following formula:

$$AlX^1_nY^1_{3-n}$$

wherein $X^1$ represents a lower alkoxy group $Y^1$ represents a ligand derived from a compound selected from the group consisting of $M^1COCH_2COM^2$ and $M^3COCH_2COOM^4$ where $M^1$, $M^2$, $M^3$ and $M^4$ independently represent a lower alkyl group, and n is an integer of 0 to 2, wherein the amount of ingredient (b) is such that the weight ratio (b)/((a)+(b)) of the ingredient (b) to a total amount of the ingredients (a) and (b) is in the range of 0.1 to 0.7;

applying the coating liquid to form a coating; and heating the coating at a temperature of 80 to 150° C. to harden the coating.

The present invention further provides an electrophotographic photoconductor comprising an electrically conductive substrate, a photoconductive layer provided thereon, and a resin layer comprising a crosslinked resin obtained by reacting an epoxy group-containing amine compound with an epoxy ring-containing silicon compound selected from the group consisting of an epoxy ring-containing alkoxysilane compound and an epoxy ring-containing silanol compound.

The present invention further provides a method of preparing an electrophotographic photoconductor, comprising the steps of:

providing a coating liquid comprising the following ingredients (a), (b) and (c) dissolved and/or dispersed in a solvent:

(a) a silane compound having at least one an epoxy group and at least one hydroxyl group bonded to the silicon atom thereof;

(b) an epoxy group-containing amine compound represented by the following formula (1):

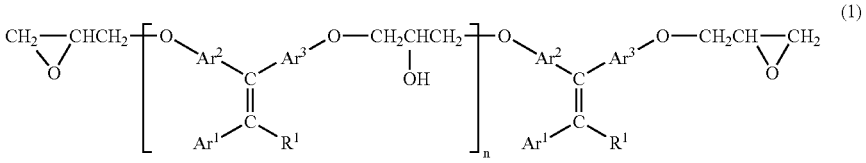

(1)

wherein $R^1$ represents a hydrogen atom, an alkyl group which may have one or more substituents, or an aryl group which may have one or more substituents, $Ar^1$ represents an aryl group having at least one tertiary amino group or a heterocyclic group having at least one tertiary amino group, $Ar^2$ and $Ar^3$ may be the same or different and each represent an arylene group which may have one or more substituents and n is an integer of 0 to 100;

(c) an aluminum chelate compound of the following formula:

$$AlX^1_nY^1_{3-n}$$

wherein $X^1$ represents a lower alkoxy group $Y^1$ represents a ligand derived from a compound selected from the group consisting of $M^1COCH_2COM^2$ and $M^3COCH_2COOM^4$ where $M^1$, $M^2$, $M^3$ and $M^4$ independently represent a lower alkyl group, and n is an integer of 0 to 2, wherein the amount of ingredient (b) is such that the weight ratio (b)/((a)+(b)) of the ingredient (b) to a total amount of the ingredients (a) and (b) is in the range of 0.1 to 0.7;

applying the coating liquid to form a coating; and heating the coating at a temperature of 80 to 150° C. to harden the coating.

The present invention further provides an electrophotographic photoconductor comprising an electrically conductive substrate, a photoconductive layer provided thereon, and a resin layer comprising a crosslinked resin obtained by reacting (I) an epoxy group-containing amine compound with (II) an epoxy ring-containing silicon compound selected from the group consisting of an epoxy ring-containing alkoxysilane compound and an epoxy ring-containing silanol compound and with (III) an epoxy ring-free silicon compound selected from the group consisting of an epoxy ring-free alkoxysilane compound and an epoxy ring-free silanol compound.

BRIEF DESCRIPTION OF DRAWINGS

Other objects, features and advantages of the present invention will become apparent from the detailed description of the preferred embodiments of the invention which follows, when considered in the light of the accompanying drawings, in which.

DETAILED DESCRIPTION OF THE PREFERRED EMBODIMENTS OF THE INVENTION

Figure 1:
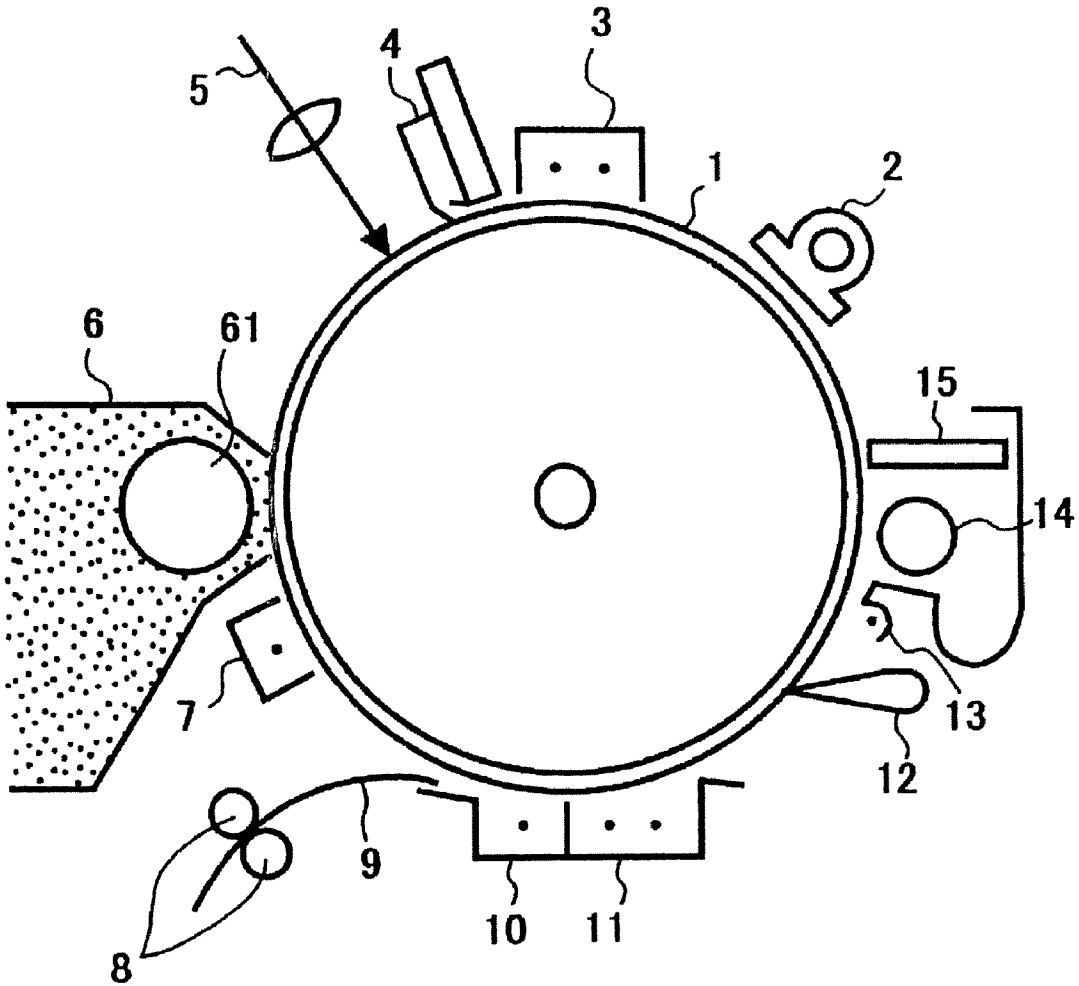
FIG. 1 is a schematic view showing an image forming apparatus according to the present invention.

An electrophotographic photoconductor according to a first aspect of the present invention comprises a resin layer containing a crosslinked resin formed by condensation of silanol groups, and charge transferability-imparting groups each bonded to a silanol group of the resin through an epoxy group.

The crosslinked resin is a three-dimensionally crosslinked resin formed as a result of condensation of silanol groups of a silane compound having three hydroxyl groups bonded to a silicon atom thereof in the presence or absence of one or more other silane compounds having at least one hydroxyl group bonded to a silicon atom thereof. The above condensation is carried out in the presence of a compound having an epoxy group and a charge transferability-imparting group so that the charge transferability-imparting group is bonded to the resin by reaction of the epoxy group with a silanol group of the resin.

In one specific embodiment of the first aspect of the present invention, the electrophotographic photoconductor has a resin layer containing a crosslinked silicone resin having $—[O—CH_2—CH(OL^1)]_p$-Z groups bonded to silicon atoms of the resin, wherein Z represents a charge transferability-imparting group, $L^1$ represents a hydrogen atom or a bond connected to a silicon atom of the resin and p is an integer of at least 1, preferably 2 or morel and when p is 2, for example, the following structure is intended: $—O—CH_2—CH(OL^1)$-$Z—CH(OL^1)$-$CH_2—O—$. The charge transferability-imparting group is suitably an nitrogen-containing group.

In another embodiment of the first aspect of the present invention, the electrophotographic photoconductor comprises an electrically conductive substrate, a photoconductive layer provided thereon, and a resin layer comprising a crosslinked resin obtained by reacting an epoxy group-containing amine compound with an epoxy ring-free silicon compound selected from the group consisting of an alkoxysilane compound and a silanol compound. The silanol compound may be a product obtained by hydrolysis of an alkoxysilane compound.

The epoxy group-containing amine compound preferably has a skeleton similar to a charge transport compound generally used as a charge transport material of an electrophotographic photoconductor, such as an oxazole compound, an oxadiazole compound, an imidazole compound, a triarylamine compound (e.g. triphenyl amine), a phenylhydrazine compound, an α-phenyl stilbene compound, a stilbene compound, a benzoimidazole compound or an N-phenylcarbazole compound. The epoxy group-containing amine compound has at least one epoxy group such as a terminal glycidyl group. The epoxy group-containing amine compound has preferably two or more epoxy groups for reasons of obtaining a high crosslinking degree and high wear resistance. It is preferred that the epoxy group-containing amine compound be used in an amount of at least 20% by weight based on a total weight of the epoxy group-containing amine compound and the epoxy ring-free silicon compound for reasons of obtaining satisfactory charge transporting properties.

The epoxy group-containing amine compound is preferably a compound represented by the following formula (I):

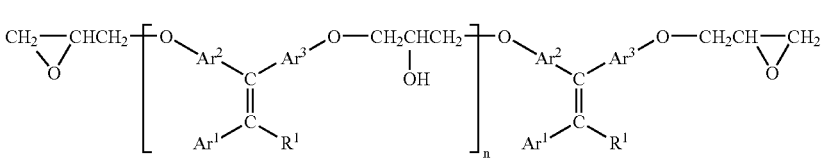

(1)

wherein $R^1$ represents a hydrogen atom, an alkyl group which may have one or more substituents, or an aryl group which may have one or more substituents, $Ar^1$ represents an aryl group having at least one tertiary amino group or a heterocyclic group having at least one tertiary amino group, $Ar^2$ and $Ar^3$ may be the same or different and each represent an arylene group which may have one or more substituents and n is an integer of 0 to 100. Therefore, the "skeleton" of the epoxy group-containing amine compound referred to above, has the following structure in light of formula (1):

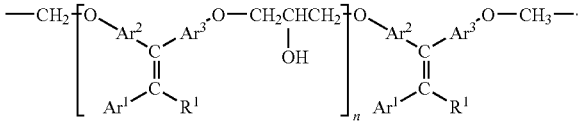

In particular, a compound represented by the following formula (2) is preferably used for the purpose of the present invention:

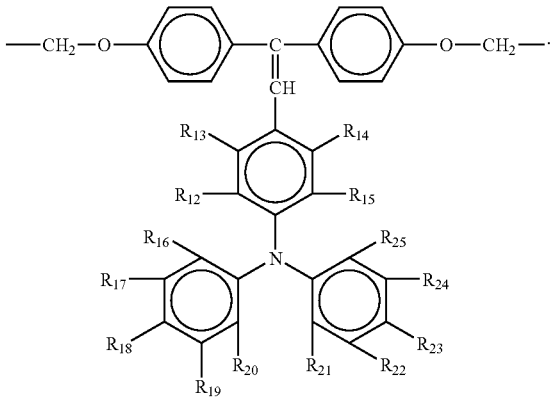

wherein $R^4$ to $R^{25}$ may be the same or different and each represent a hydrogen atom, a halogen atom or an alkyl group which may have one or more substituents and n is an integer of 0 to 100. The epoxy group-containing amine compounds of the formulas (1) and (2) above, which are novel compounds, may be prepared by reacting the corresponding hydroxyl compounds with a glycidylating agent.

When such epoxy group-containing amine compound reacts with an epoxy ring-free silicon compound, the resultant resin includes the skeleton of the epoxy group-containing amine compound as a charge transferability-imparting group, and the skeleton is represented by Z in $—[O—CH_2—CH(OL^1)]_p$-Z. The skeleton has the following structure, for example, when n is zero, $R^1$ is a hydrogen atom, $Ar^1$ is a triarylamine group, and $Ar^2$ and $Ar^3$ are an aryl group:

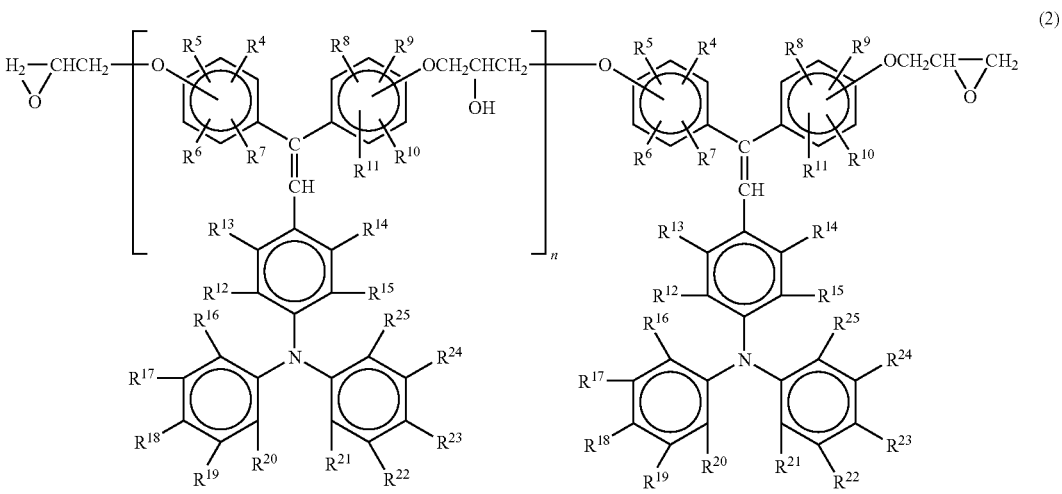

(2)

In the epoxy group-containing amine compounds of the above formulas (1) and (2) above, each of the alkyl groups $R^1$ and $R^4$ to $R^{25}$ may be a linear or branched alkyl group which has preferably 1 to 5 carbon atoms and which may have one or more substituents such as a halogen atom (e.g. chlorine, fluorine, bromine or iodine), an aryl group (e.g. phenyl or naphthyl) or an aralkyl group (e.g. benzyl). Each of the aryl and aralkyl groups may have a substituent such as a halogen atom or an alkyl group having 1 to 5 carbon atoms. Specific examples of the alkyl groups $R^1$ and $R^4$ to $R^{25}$ include methyl, ethyl, n-propyl, i-propyl, t-butyl, s-butyl, n-butyl, i-butyl, n-pentyl, trifluoromethyl, phenyl, chlorophenyl, benzyl, 4-chlorobenzyl and 4-methylbenzyl.

The aryl group represented by $R^1$ may be, for example, phenyl, naphthyl, biphenylyl, terphenylyl, pyrenyl, fluorenyl, 9,9-dimethyl-2-fluorenyl, azulenyl, anthryl, triphenyl or crysenyl. The aryl group may have one or more substituents such as a halogen atom (e.g. chlorine, fluorine, bromine or iodine), an alkyl group (e.g. C1 to C5 alkyl group) an aryl group (e.g. phenyl or naphthyl) or an aralkyl group (e.g. benzyl).

The aryl group represented by $R^1$ may also be a group of the following formula (5):

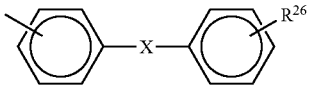

(5)

wherein $R^{26}$ represents a hydrogen atom, a halogen atom, an alkyl group which may have one or more substituents, an aryl group which may have one or more substituents or an aralkyl group which may have one or more substituents, and X represents —O—, —S—, —SO—, —$SO_2$—, —CO—, an alkylene which may have one or more substituents or an alkylene of the formula:

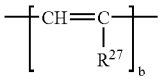

where $R^{27}$ represents a hydrogen atom, a halogen atom, an alkyl group which may have one or more substituents, an aryl group which may have one or more substituents or an aralkyl group which may have one or more substituents, and b is an integer of 1 to 3.

The alkylene represented by X preferably has 1-12 carbon atoms such as methylene, ethylene, propylene, butylene, pentylene, hexylene, heptylene, octylene, nonylene, decylene, undecylene or dodecylene. Examples of the substituent for the alkyl group, aryl group and aralkyl group of $R^{26}$ and $R^{27}$ include those described above with reference to the groups $R^1$ and $R^4$ to $R^{25}$. The substituent of the alkylene group of X may be a halogen atom, an alkyl group (e.g. C1 to C5 alkyl group) an aryl group (e.g. phenyl or naphthyl) or an aralkyl group (e.g. benzyl).

In the epoxy group-containing amine compounds of the above formula (1) above, the aryl group of the tertiary amino group-containing aryl group $Ar^1$ may be the same as that described above in connection with the group $R^1$. The tertiary amino group may be a group of the formula —$X^2$—N($Ar^5$)($Ar^6$) where $X^2$ represents a divalent organic group such as an alkylene group having one or more substituents, an alkenylene group having one or more substituents, an arylene group having one or more substituents and an aralkylene group having one or more substituents, and $Ar^5$ and $Ar^6$ independently represent an aryl group such as phenyl having one or more substituents.

The substituent for each of the groups $X^2$, $Ar^5$ and $Ar^6$ may be a halogen atom or an alkyl group which may have one or more substituents. The alkyl group may be a linear or branched alkyl group which has preferably 1 to 5 carbon atoms and which may have one or more substituents such as a halogen atom (e.g. chlorine, fluorine, bromine or iodine), an aryl group (e.g. phenyl or naphthyl) or an aralkyl group (e.g. benzyl).

In the epoxy group-containing amine compounds of the above formula (1) above, each of the arylene groups $Ar^2$ and $Ar^3$ may be, for example, phenylene, naphthylene, biphenylylene, terphenylylene, pyrenylene, fluorenylene, 9,9-dimethyl-2-fluorenylene, azulenylene, anthrylene, triphenylene or crysenylene. The arylene group may have one or more substituents such as a halogen atom (e.g. chlorine, fluorine, bromine or iodine), an alkyl group (e.g. C1 to C5 alkyl group) an aryl group (e.g. phenyl or naphthyl) or an aralkyl group (e.g. benzyl).

In the epoxy group-containing amine compounds of the above formula (1) above, the heterocyclic group of the tertiary amino group-containing heterocyclic group $Ar^1$ may be, for example, pyrrole, pyrazole, imidazole, triazole, dioxazole, indole, isoindole, benzimidazole, benzotriazole, benzisoxazine, carbazole or phenoxazine. The heterocyclic group may have one or more substituents such as a halogen atom (e.g. chlorine, fluorine, bromine or iodine), an aryl group (e.g. phenyl or naphthyl) or an aralkyl group (e.g. benzyl). Each of the aryl and aralkyl groups may have a substituent such as a halogen atom or an alkyl group having 1 to 5 carbon atoms. Examples of the tertiary amino group include those described above in connection with the tertiary amino group-containing aryl group.

The alkoxysilane compound to be reacted with the epoxy group-containing amine compound may be, for example, a compound represented by the following formula (3):

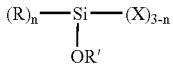

(3)

wherein R represents an organic group having a carbon atom bonded to the Si atom of the formula (3), R' represents an alkyl group, X represents a hydrolyzable group and n is an integer of 0 to 3.

The organic group R may be, for example, an alkyl group, preferably a lower alkyl group, which may have one or more substituents, an aryl group which may have one or more substituents or an aralkyl group which may have one or more substituents. The substituent of each of the alkyl group, aryl group and aralkyl group may be, for example, a halogen atom, a nitro group, a cyano group or an alkyl group having 1 to 5 carbon atoms. Specific examples of the organic group R include methyl, ethyl, propyl, butyl, phenyl, naphthyl, biphenyl, tolyl, benzyl, γ-chloropropyl, 1,1,1-trifluoropropyl, nonafluorohexyl and perfluorooctyl.

The alkyl group R' is preferably a lower alkyl group having 1 to 8 carbon atoms, more preferably 1 to 6 carbon atoms. The hydrolyzable group X may be, for example, an alkoxyl group, a halogen atom or an acyloxy group. An alkoxyl group having 1 to 6 carbon atoms is preferably used as the hydrolyzable group X. If desired a mixture of the alkoxysilane compounds of the formula (3) having different alkyl groups R' and/or different hydrolyzable groups X may be used.

The silanol compound to be reacted with the epoxy group-containing amine compound may be, for example, a compound represented by the following formula (4):

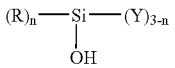

(4)

wherein R represents an organic group having a carbon atom bonded to the Si atom of the formula (4), Y represents a hydroxyl group or a hydrolyzable group and n is an integer of 0 to 3. Examples of the organic group R and the hydrolyzable group Y in the formula (4) include those described above with reference to the alkoxysilane compound of the formula (3).

When n of the organic silicon compound of the formula (3) or (4) is 2 or more, the two or three groups R may be the same or different. Similarly, when n is 1 or less, the two or three groups X or Y may be the same or different.

The resin layer of an electrophotographic photoconductor according to the present invention may be a layer obtained by reacting a coating of a composition containing the above epoxy group-containing amine compound and the silicon compound. The reaction of the coating may be carried out by heating the coating at a temperature of at least 100° C. In this case, it is preferred that at least one of the alkoxysilane compound and the silanol compound has at least one group R which is an aromatic group for reasons of improving the uniformity and transparency of the resin layer. It is still preferred that the aromatic group-containing alkoxysilane compound and/or silanol compound be used in conjunction with an aromatic group-free alkoxysilane compound and/or silanol compound.

When n of the organic silicon compound of the formula (3) or (4) is 2 or less, the silicon compound undergoes condensation to form an organopolysiloxane resin. When n is 2, a three-dimensionally crosslinked organopolysiloxane resin (silicone resin) is obtained. Thus, it is preferred that the organic silicon compound used as a raw material contain a trifunctional silane monomer. By using the trifunctional silane monomer in conjunction with a mono- di- and/or tetrafunctional silane monomers, characteristics such as stability and mechanical strengths of the resin layer can be controlled.

The reaction of the epoxy group-containing amine compound with the alkoxysilane compound involves (1) condensation between alkoxysilane molecules, (2) condensation between alkoxysilane and silanol produced by hydrolysis of the alkoxysilane, (3) condensation between silanol molecules produced by hydrolysis of the alkoxysilane, (4) addition of the epoxy group of the epoxy group-containing amine to silanol and (5) condensation of the hydroxyl group formed as a result of the ring-opening addition reaction of the epoxy group with silanol and results in a three-dimensionally crosslinked silicone resin. Similarly, the reaction of the epoxy group-containing amine compound with the silanol compound involves (1) condensation between silanol molecules, (2) addition of the epoxy group of the epoxy group-containing amine to silanol and (3) condensation of the hydroxyl group formed as a result of the ring-opening addition reaction of the epoxy group with silanol and results in a three-dimensionally crosslinked silicone resin.

The coating composition containing the above epoxy group-containing amine compound and the silicon compound for forming the resin layer may be prepared by blending the epoxy group-containing amine compound, the silicon compound, a suitable solvent and, optionally, a catalyst for accelerating the crosslinking. In this case, the silicon compound of the formula (3) and/or (4) may be previously subjected to a hydrolysis treatment for hydrolyzing the hydrolyzable groups X and Y and the alkoxyl group OR' under acidic or alkaline conditions. Alternatively, the coating composition formulated may be subjected to hydrolysis prior to the coating step. Hydrolysis may also be carried out after the coating step at the time the crosslinking is performed.

In one preferred embodiment, the silicon compound of the formula (3) and/or (4) may be hydrolyzed in water or in an aqueous solution containing an acid, such as hydrochloric acid, sulfuric acid or acetic acid, by it self or in the presence of a suitable solvent. When a plurality of the silicon compounds are used in combination, they may be first hydrolyzed separately and then mixed with each other. In an alternate, they may be first mixed with each other and the mixture is then subjected to hydrolysis. Further, they may be successively mixed after the silicon compound previously added has been hydrolyzed.

The solvent used for the coating composition is suitably a mixed solvent containing an alcohol solvent and at least one additional solvent such as an aromatic solvent, a ketone solvent, an ester solvent and ether solvent. Illustrative of suitable alcohol solvents are methanol, ethanol, 1-propanol, 2-propanol, 1-butanol, t-butanol and benzyl alcohol. Illustrative of suitable aromatic solvents are toluene and xylene. Illustrative of suitable ketone solvents are methyl ethyl ketone, methyl isobutyl ketone, acetone, acetylacetone and cyclohexanone. Illustrative of suitable ester solvents are ethyl acetate, 2-methoxyethyl acetate and t-butyl acetate. Illustrative of suitable ether solvents are methyl cellosolve, ethyl cellosolve, diethyl ether, dibutyl ether, dipropyl ether, tetrahydrofuran, 1,4-dioxane and 1,3-dioxolane.

While a variety of solvents may be used for the preparation of the coating composition, it is desirable that the solvent be able to dissolve the silicon compounds and epoxy group-containing amine compound and have a relatively high boiling point for reasons of formation of a uniform crosslinked resin layer. Examples of such a solvent include butanol, benzyl alcohol, cyclohexanone, 2-methoxyethyl acetate, tetrahydrofuran and acetylacetone. Benzyl alcohol and cyclohexanone are especially preferably used. The amount of the solvent in the coating composition varies depending upon the structures of the silicon compound and epoxy group-containing amine compound and the coating method adopted but is generally such that the solid content of the coating composition is in the range of 2 to 50% by weight.

As the catalyst for acceleration of the crosslinking, there may be mentioned alkali metal salts of organic carboxylic acids, nitrous acid, sulfurous acid, aluminic acid, carbonic acid and thiocyanic acid; organic amine salts such as tetramethylammonium hydroxide and tetramethylammonium acetate; organic acid salts of tin such as stannous octoate, dibutyl tin diacetate, dibutyl tin dilaurate, dibutyl tin mercaptide, dibutyl tin thiocarboxylate and dibutyl tin malleate; aluminum salts of octenic acid and naphthenic acid; zinc salts of octenic acid and naphthenic acid; and acetylacetone complexes of aluminum and zinc. The catalyst is preferably used in an amount of 0.1 to 10 parts by weight per 100 parts by weight of the silicon compound.

Above all, the use of an aluminum chelate compound of the following formula:

$$AlX^1_nY^1_{3-n}$$

wherein $X^1$ represents a lower alkoxy group $Y^1$ represents a ligand derived from a compound selected from the group consisting of $M^1COCH_2COM^2$ and $M^3COCH_2COOM^4$ where $M^1$, $M^2$, $M^3$ and $M^4$ independently represent a lower alkyl group, and n is an integer of 0 to 2, is preferable for reasons of long pot life of the coating composition. Namely, the above aluminum chelate does not catalyze the crosslinking at ambient temperature but can accelerate the crosslinking at an elevated temperature. For reasons of catalytic activity, solubility and stability, the use of aluminum acetylacetonate, aluminum ethylacetoacetate bisacetylacetonate, aluminum bisacetoacetate acetylacetonate, aluminum di-n-butoxide monoethylacetoacetate, aluminum di-i-propoxide monomethylacetoacetate or a mixture thereof is particularly preferably used.

The coating composition may suitably additionally contain a colloidal metal oxide such as colloidal silica or colloidal alumina for reasons of improved film forming property, improved hardness and improved resistance to scratch and prevention of cracks in the resin layer. Preferably used is colloidal silica in the form of an aqueous or alcoholic sol having a particle diameter of 100 nm or less, more preferably 50 nm or less. Fine silica particles having an average particle diameter of 1 to 100 nm may also be used as the colloidal silica. The colloidal silica is generally used in an amount of 1 to 30% by weight based on the weight of the resin layer.

The coating composition may further contain various additives customarily used in known electrophotographic photoconductors, such as an antioxidant (e.g. sterically hindered amine or sterically hindered phenol), a lubricant such as silicone oil, a positive hole transporting agent such as an amine compound and an electron transporting agent such as a quinone.

A coating of the above coating composition is dried to obtain a crosslinked resin layer. The drying conditions vary depending upon the kind of the solvent used, presence or absence of catalyst, etc., but are generally 60 to 160° C. for 10 minutes to 5 hours, preferably 80 to 150° C. for 20 minutes to 3 hours, more preferably 100 to 150° C. for 30 minutes to 2 hours, for reasons of formation of sufficient crosslinkages and prevention of thermal degradation of components of the resin layer.

In one preferred embodiment of the first aspect of the present invention, the resin layer of an electrophotographic photoconductor of the present invention is a hardened layer of a composition which includes the following ingredients (a), (b) and (c):

(a) a silane compound having at least one hydroxyl group bonded to the silicon atom thereof;

(b) an epoxy group-containing amine compound represented by the following formula (1):

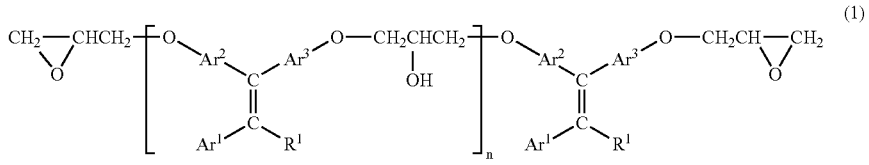

(1)

wherein $R^1$ represents a hydrogen atom, an alkyl group which may have one or more substituents, or an aryl group which may have one or more substituents, $Ar^1$ represents an aryl group having at least one tertiary amino group or a heterocyclic group having at least one tertiary amino group, $Ar^2$ and $Ar^3$ may be the same or different and each represent an arylene group which may have one or more substituents and n is an integer of 0 to 100;

(c) an aluminum chelate compound of the following formula:

$$AlX^1_nY^1_{3-n}$$

wherein $X^1$ represents a lower alkoxy group $Y^1$ represents a ligand derived from a compound selected from the group consisting of $M^1COCH_2COM^2$ and $M^3COCH_2COOM^4$ where $M^1$, $M^2$, $M^3$ and $M^4$ independently represent a lower alkyl group, and n is an integer of 0 to 2, wherein the amount of ingredient (b) is such that the weight ratio (b)/((a)+(b)) of the ingredient (b) to a total amount of the ingredients (a) and (b) is in the range of 0.1 to 0.7.

The ingredient (a) is a hydrolyzed product of the silicon compound of the formula (3) and/or (4). The weight ratio (b)/((a)+(b)) in the range of 0.1 to 0.7 is desired to provide a resin layer having high mechanical strengths such as wear resistance and to prevent an increase of residual potential or a reduction of sensitivity of the photoconductor. The ingredient (c) is generally used in an amount of 0.01 to 30 parts by weight per 100 parts by weight of a total amount of ingredients (a) and (b).

In the above embodiment, the composition of the hardened layer preferably includes the following ingredient (d):

(d) finely divided silica having an average particle diameter of 1 to 100 nm, wherein the amounts of ingredients (b) and (d) are such that the weight ratio (b)/((a)+(b)+(d)) of ingredient (b) to a total amount of the ingredients (a), (b) and (d) is in the range of 0.1 to 0.6 and the weight ratio (d)/((a)+(b)+(d)) of ingredient (d) to a total amount of the ingredients (a), (b) and (d) is in the range of 0.01 to 0.3.

The weight ratio (b)/((a)+(b)+(d)) in the range of 0.1 to 0.6 is desired to provide a resin layer having high mechanical strengths such as wear resistance and to prevent an increase of residual potential or a reduction of sensitivity of the photoconductor. The weight ratio (d)/((a)+(b)+(d)) of 0.01 to 0.3 is desired to provide a resin layer having high mechanical strengths such as wear resistance and to prevent formation of cracks of the resin layer and a reduction of resolution of the photoconductor. The ingredient (c) is generally used in an amount of 0.01 to 30 parts by weight per 100 parts by weight of a total amount of ingredients (a), (b) and (d).

An electrophotographic photoconductor according to a second aspect of the present invention comprises a layer containing a crosslinked resin having a first chain or moiety formed by condensation of silanol groups and a second chain or moiety formed by addition of a silanol group to an epoxy group, and charge transferability-imparting groups each bonded to a silanol group of the resin through an epoxy group.

The crosslinked resin of the second aspect is a three-dimensionally crosslinked resin formed as a result of condensation of silanol groups and addition of a silanol group to an epoxy group. The above condensation and addition reactions are carried out in the presence of a compound having an epoxy group and a charge transferability-imparting group so that the charge transferability-imparting group is bonded to the resin by the reaction of the epoxy group with a silanol group of the resin.

In one specific embodiment of the second aspect of the present invention, the electrophotographic photoconductor has a resin layer containing a crosslinked silicone resin having a group of the following formula:

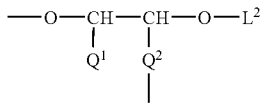

bonded to silicon atoms of the resin, wherein $Q^1$ represents a hydrogen atom and $Q^2$ represents an oxyalkylene group or an alkylene group, or $Q^1$ and $Q^2$ are taken in combination to represent a cycloalkylene group or a cycloalkylenealkylene group and $L^2$ represents a hydrogen atom or a bond connected to a silicon atom of the resin, and $—[O—CH_2—CH(OL^1)]_p$-Z groups bonded to silicon atoms of the resin, wherein Z represents a charge transferability-imparting group, $L^1$ represents a hydrogen atom or a bond connected to a silicon atom of the resin and p is an integer of 1 or more, preferably 2 or more.

In another embodiment of the second aspect of the present invention, the electrophotographic photoconductor comprises an electrically conductive substrate, a photoconductive layer provided thereon, and a resin layer comprising a crosslinked resin obtained by reacting an epoxy group-containing amine compound with an epoxy ring-containing silicon compound selected from the group consisting of an epoxy ring-containing alkoxysilane compound and an epoxy ring-containing silanol compound. The epoxy ring-containing silanol compound may be a product obtained by hydrolysis of an epoxy ring-containing alkoxysilane compound.

The epoxy group-containing amine compound may be the same as that described above with reference to the first aspect of the present invention.

The epoxy ring-containing silicon compound to be reacted with the epoxy group-containing amine compound may be, for example, an epoxy ring-containing alkoxysilane compound represented by the following formula (6):

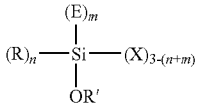

(6)

wherein R represents an organic group having a carbon atom bonded to the Si atom of the formula (6), R' represents an alkyl group, E represents an epoxy ring-containing group, X represents a hydrolyzable group, n is an integer of 0 to 2 and m is an integer of 1 to 3. The epoxy ring-containing silicon compound to be reacted with the epoxy group-containing amine compound may also be, for example, an epoxy ring-containing silanol compound represented by the following formula (7):

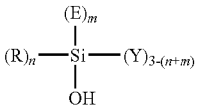

(7)

wherein R represents an organic group having a carbon atom bonded to the Si atom of the formula (7), E represents an epoxy ring-containing group, Y represents a hydroxyl group or a hydrolyzable group, n is an integer of 0 to 2 and m is an integer of 1 to 3. When n of the epoxy ring-containing silicon compound of the formula (6) or (7) is 2, the two groups R may be the same or different. Similarly, when n is zero and m is 1, the two groups X or Y may be the same or different. Further, when m is 2 or 3, the two or three groups E may be the same or different.

The organic group R, the alkyl group R' and the hydrolyzable groups X and Y may be the same as those described with reference to the silicon compounds of the formulas (3) and (4) above. The epoxy ring-containing group E may be, for example, a glycidyl group, a glycidoxy group, a glycidylalkyl group preferably having 3 to 10 carbon atoms, a glycidoxyalkyl group preferably having 3 to 10 carbon atoms, an epoxycyloalkyl group preferably having 3 to 12 carbon atoms, such as a cyclohexene oxide group, a tricyclodecene oxide group or a cyclopentene oxide group or an epoxycycloalkylalkyl group preferably having 3 to 15 carbon atoms.

Specific examples of the epoxy ring-containing alkoxysilane compound include 3-glycidoxypropyl-trimethoxysilane, 3-glycidoxypropyldimethylmethoxysilane, 3-glycidoxypropyltriethoxysilane, 3-glycidoxypropylmethyldiethoxysilane, 2-(3,4-epoxycyclohexyl)ethyltrimethoxysilane, 2-(3,4-epoxycyclohexyl)ethyltriethoxysilane, and 5,6-epoxyhexyltriethoxysilane.

The epoxy ring-containing silanol compound may be a product obtained by hydrolyzing the above epoxy ring-containing alkoxysilane compound. In one preferred embodiment, the epoxy ring-containing silicon compound of the formula (6) and/or (7) may be hydrolyzed in water or in an aqueous solution containing an acid, such as hydrochloric acid, sulfuric acid or acetic acid, by it self or in the presence of a suitable solvent. When a plurality of the silicon compounds are used in combination, they may be first hydrolyzed separately and then mixed with each other. In an alternate, they may be first mixed with each other and the mixture is then subjected to hydrolysis. Further, they may be successively mixed after the silicon compound previously added has been hydrolyzed.

It is preferred that the epoxy ring-containing silicon compound be used in conjunction with an epoxy ring-free silicon compound such as a silicon compound of the formula (3) or (4) above for reasons of easy control of the properties of the resin layer.

Similar to the above-described first aspect, the resin layer of an electrophotographic photoconductor according to the second aspect of the present invention may be a layer obtained by reacting a coating of a composition containing the above epoxy group-containing amine compound and the epoxy ring-containing silicon compound. The reaction of the coating may be carried out by heating the coating at an elevated temperature.

The reaction of the epoxy group-containing amine compound with the epoxy ring-containing silicon compound (alkoxysilane or silanol) involves (1) condensation between alkoxysilane molecules, (2) condensation between silanol molecules including those produced by hydrolysis of the alkoxysilane, (3) addition of the epoxy group of the epoxy group-containing amine to silanol, (4) ring open polymerization of the epoxy ring-containing silicon compound by addition of the epoxy group thereof to silanol and (5) condensation of the hydroxyl group formed as a result of the ring-opening addition reaction of the epoxy group with silanol, and results in a three-dimensionally crosslinked silicone resin. Similarly, the reaction of the epoxy ring-containing silicon compound (alkoxysilane or silanol) (C) with the epoxy group-containing amine compound (B) and the epoxy group-free silicon compound (alkoxysilane or silanol) (A) involves (1) condensation between alkoxysilane molecules (of C and A), (2) condensation between silanol molecules (of C and A) including those obtained by hydrolysis of the alkoxysilane (of C and A), (3) addition of the epoxy group of the epoxy group-containing amine (B) to silanol (of C and A), (4) ring open polymerization of the epoxy ring-containing silicon compound (C) by addition of the epoxy group thereof to silanol (of C and A) and (5) condensation of the hydroxyl group formed as a result of the ring-opening addition reaction of the epoxy group (of B and C) with silanol (of C and A), and results in a three-dimensionally crosslinked silicone resin. In the presence of a chain polymerization catalyst, ring opening polymerization thereof is likely to occur.

The coating composition containing the above epoxy group-containing amine compound, the epoxy ring-containing silicon compound and, optionally, the epoxy group-free silicon compound for forming the resin layer may be prepared by blending the epoxy group-containing amine compound, the silicon compounds, a suitable solvent and, optionally, a catalyst for accelerating the crosslinking. In this case, the silicon compounds of the formulas (3), (4), (6) and/or (7) may be previously subjected to a hydrolysis treatment for hydrolyzing the hydrolyzable groups X and Y and the alkoxyl group OR' under acidic or alkaline conditions. Alternatively, the coating composition formulated may be subjected to hydrolysis prior to the coating step. Hydrolysis may also be carried out after the coating step at the time the crosslinking is performed.

The solvent and catalyst used in the second aspect of the present invention are similar to those described above in connection with the first aspect. Further, a catalyst for accelerating ring opening polymerization of epoxy groups may suitably incorporated into the coating composition. Such a catalyst may be, for example, a Lewis acid (e.g. $SnCl_2$, $BF_3$, $AlCl_3$, $PF_5$, $AsF_5$ or $SbF_5$), an amine salt or complex of $BF_3$ or a proton acid (e.g. hydrochloric acid or sulfuric acid). Above all, the use of an amine complex is preferred for reasons of a long pot life. The ring opening polymerization catalyst is generally used in an amount of 0.1 to 10 parts by weight per 100 parts by weight of the epoxy compounds.

The coating composition may suitably additionally contain a colloidal metal oxide, such as colloidal silica or colloidal alumina, and various other additives customarily used in known electrophotographic photoconductors, similar to the above-described first aspect. A coating of the above coating composition is dried to obtain a crosslinked resin layer. The drying conditions are the same as those described above in connection with the first aspect.

In one preferred embodiment of the second aspect of the present invention, the resin layer of an electrophotographic photoconductor of the present invention is a hardened layer of a composition which includes the following ingredients (a), (b) and (c):

(a) a silane compound having at least one epoxy group and at least one hydroxyl group bonded to the silicon atom thereof and, optionally, an epoxy group-free silane compound having at least one hydroxyl group;

(b) an epoxy group-containing amine compound represented by the following formula (1):

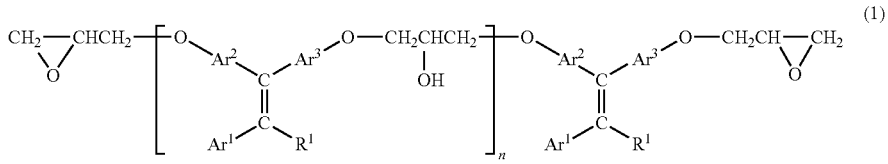

(1)

wherein $R^1$ represents a hydrogen atom, an alkyl group which may have one or more substituents, or an aryl group which may have one or more substituents, $Ar^1$ represents an aryl group having at least one tertiary amino group or a heterocyclic group having at least one tertiary amino group, $Ar^2$ and $Ar^3$ may be the same or different and each represent an arylene group which may have one or more substituents and n is an integer of 0 to 100;

(c) an aluminum chelate compound of the following formula:

$$AlX^1_nY^1_{3-n}$$

wherein $X^1$ represents a lower alkoxy group $Y^1$ represents a ligand derived from a compound selected from the group consisting of $M^1COCH_2COM^2$ and $M^3COCH_2COOM^4$ where $M^1$, $M^2$, $M^3$ and $M^4$ independently represent a lower alkyl group, and n is an integer of 0 to 2, wherein the amount of ingredient (b) is such that the weight ratio (b)/((a)+(b)) of the ingredient (b) to a total amount of the ingredients (a) and (b) is in the range of 0.1 to 0.7.

The ingredient (a) is a hydrolyzed product of the epoxy ring-containing silicon compound of the formula (6) and/or (7). The weight ratio (b)/((a)+(b)) in the range of 0.1 to 0.7 is desired to provide a resin layer having high mechanical strengths such as wear resistance and to prevent an increase of residual potential or a reduction of sensitivity of the photoconductor. The ingredient (c) is generally used in an amount of 0.01 to 30 parts by weight per 100 parts by weight of a total amount of ingredients (a) and (b).

In the above embodiment, the composition of the hardened layer preferably includes the following ingredient (d):

(d) finely divided silica having an average particle diameter of 1 to 100 nm, wherein the amounts of ingredients (b) and (d) are such that the weight ratio (b)/((a)+(b)+(d)) of ingredient (b) to a total amount of the ingredients (a), (b) and (d) is in the range of 0.1 to 0.6 and the weight ratio (d)/((a)+(b)+(d)) of ingredient (d) to a total amount of the ingredients (a), (b) and (d) is in the range of 0.01 to 0.3.

The weight ratio (b)/((a)+(b)+(d)) in the range of 0.1 to 0.6 is desired to provide a resin layer having high mechanical strengths such as wear resistance and to prevent an increase of residual potential or a reduction of sensitivity of the photoconductor. The weight ratio (d)/((a)+(b)+(d)) of 0.01 to 0.3 is desired to provide a resin layer having high mechanical strengths such as wear resistance and to prevent formation of cracks of the resin layer and a reduction of resolution of the photoconductor. The ingredient (c) is generally used in an amount of 0.01 to 30 parts by weight per 100 parts by weight of a total amount of ingredients (a), (b) and (d).

The electrophotographic photoconductor in accordance with the first and second aspect of the present invention has a layer of a crosslinked resin obtained by reacting an epoxy group-containing amine compound having a charge transferability-imparting group with at least one silicon compound selected from the group consisting of an epoxy ring-free alkoxysilane compound, an epoxy ring-free silanol compound, an epoxy ring-containing alkoxysilane compound and an epoxy ring-containing silanol compound.

The construction of the electrophotographic photoconductor according to the present invention will be described next.

The electrophotographic photoconductor generally comprises an electrically conductive substrate and a photoconductive layer provided thereon.

Any conventionally used conductive substrate may be used for the purpose of the present invention. A sheet or drum made of a metal such as aluminum or nickel or a composite sheet or drum composed of a paper or plastic base coated with a metal such as aluminum, nickel, chromium, nichrome, copper, silver, gold, platinum or iron, or an oxide such as tin oxide or indium oxide, by any coating method such as a vacuum deposition method or a sputtering method may be suitably used as the conductive substrate.

The photoconductive layer provided on the substrate may have any desired construction. The photoconductive layer may be a mix type photoconductive layer in which a charge generating material and a charge transporting material are homogeneously dispersed, or a multi-layered photoconductive layer in which at least one charge generating material-containing layer and at least one charge transporting material-containing layer are superimposed one over the other. An undercoat layer or a liner may be suitably interposed between the conductive substrate and the photoconductive layer. It is also preferred that a surface protective layer be provided on the photoconductive layer.

At least one of the above layers formed on the conductive substrate may be a layer containing the above-described crosslinked silicone resin. When the photoconductive layer has a multi-layered structure, one of the multi-layers, preferably the outermost layer of the multi-layers, may comprise the above-described crosslinked silicone resin. For reasons of obtaining excellent properties of the crosslinked silicone resin layer, it is preferred that the outermost layer of the photoconductor comprise the crosslinked silicone resin so as to function as a surface protective layer. In one typical preferred embodiment of the present invention, the photoconductor has a construction of a conductive substrate, an undercoat layer, a charge generating layer, a charge transporting layer and a surface protective layer containing the above-described crosslinked silicone resin, arranged in this order. The surface protective layer generally has a thickness of 0.1 to 15 μm, preferably 1 to 15 μm, from the standpoint of abrasion resistance and prevention of cracks and falling off.

As the charge generation material used in the charge generating layer, any conventionally employed substance may be suitably used for the purpose of the present invention. Examples of the charge generation material include metal phthalocyanines such as A-type, B-type and Y-type titanylphthalocyanines and copper phthalocyanine; X-type and τ-type metal-free phthalocyanines; naphthalocyanine; mixtures of the above; azo compounds; pyrilium compounds; perylene compounds; cyanine compounds; squalerium compounds; and polycyclic quinone compounds. The charge generation material may be used by itself as the charge generating layer or may be dispersed in a binder resin.

Any customarily employed charge transport material may be used in the charge transporting layer of the present invention. Examples of the positive hole transporting material include nitrogen-containing heterocyclic compounds, such as oxazole, oxadiazole, thiazole, thiadiazole, imadazole and derivatives thereof, polyarylakane compounds, hydrazone compounds, pyrazoline compounds, triarylamine compounds, styryl compounds, poly(bis)styryl compounds, styryltriphenylamine compounds, β-phenylstyryltriphenylamine compounds, butadiene compounds, hexatriene compounds, carbazole compounds and condensed polycyclic compounds. Typical examples of the electron transporting material include benzoquinone, naphthoquinone, anthraquinone, thiopyranone, fluorenone compounds, indenone compounds and indandione compounds. The charge transporting material may be dispersed in a binder resin.

The binder resin used in the photoconductive layer may be, for example, a styrene resin, an acrylic resin, a methacrylic resin, a vinyl chloride resin, a vinyl acetate resin, a polyvinylbutyral resin, an epoxy resin, an urethane resin, a phenol resin, a polyester resin, an alkyd resin, a polycarbonate resin, a silicone resin, a melamine resin, or a copolymer resin containing two or more of the above resins. In addition to the above electrically insulating resins, there may be used an organic polymeric semiconductor such as poly-N-vinylcarbazole.

The charge generation material is suitably used in an amount of 50 to 600 parts by weight per 100 parts by weight of the binder resin. The amount of the charge transport material is suitably in the range of 10 to 100 parts by weight per 100 parts by weight of the binder resin. The thickness of the charge generating layer is generally 0.1 to 10 μm, while that of the charge transporting layer is generally 5 to 30 μm. When the photoconductive layer is a single layer, the thickness thereof is suitably 5 to 40 μm.

The photoconductive layer is generally prepared by a coating method. A solvent or dispersing medium used to dissolve or disperse the charge generation material and/or the charge transport material for the preparation of a charge generation layer coating liquid, a charge transporting layer coating liquid or a single-layer photoconductive layer coating liquid may be, for example, a hydrocarbon solvent such as toluene or xylene; a halogenated hydrocarbon solvent such as methylene chloride or 1,2-dichloroethane; a ketone solvent such as methyl ethyl ketone or cyclohexanone; an ester solvent such as ethyl acetate or butyl acetate; an alcohol solvent such as methanol, ethanol, methyl cellosolve or methyl cellosolve; an ether solvent such as tetrahydrofuran, 1,3-dioxane or 1,3-dioxoran; an amine solvent such as pyridine or diethylamine; an amide solvent such as N,N-dimethylformamide; a fatty acid solvent; a phenol or its derivative; a sulfur compound solvent such as carbon disulfide; or a phosphorus compound solvent such as triethyl phosphate.

The undercoat layer may be a resin layer containing a polyamide resin, a vinyl chloride resin, a vinyl acetate resin, or a copolymer resin containing two or more of the above resins. A metal resin obtained by thermally hardening an organic metal compound such as a silane coupling agent or a titanium coupling agent may also be used for the formation of the undercoat layer. The thickness of the undercoat layer is suitably in the range of 0.01 to 15 μm.

In the electrophotographic photoconductor of the present invention, an additive such as an antioxidant or a sensitizing dye may be contained in any desired layer. The antioxidant may be incorporated into a layer containing an organic material therein in order to prevent the decrease of photosensitivity and the increase of residual potential. In particular, satisfactory results can be obtained when the antioxidant is added to the layer which comprises the charge transport material. The sensitizing dye is generally added to the photoconductive layer.

Any conventionally employed coating method may be suitably used for the preparation of the electrophotographic photoconductor of the present invention. Illustrative of suitable coating methods are an immersion coating method, a spray coating method and a coating method using a coating amount controlling circular coating means such as a ring shaped slide hopper coating apparatus. The spray coating and the coating using the coating amount controlling circular coating means are particularly preferably used since dissolution of the under layer may be prevented and since uniform coating may be attained. The spray coating method is described in Japanese Laid Open Patent Publications No. H03-90250 and No. H03-269238 and the coating amount controlling circular coating means is described in Japanese Laid Open Patent Publication No. S58-189061.

Next, the image forming apparatus and process cartridge of the present invention will be explained with reference to the drawings.

FIG. 1 is a schematic view illustrating the essential part of one embodiment of the image forming apparatus of the present invention. In FIG. 1, the reference numeral 1 denotes a cylindrical photoconductor which is the photoconductor according to the present invention as described above. In an alternate, the photoconductor 1 may be in the form of a sheet or an endless belt. Provided around the photoconductor 1 are a discharging lamp 2, a charger 3, an eraser 4, an imagewise light exposing device 5, a developing device 6 for developing an electrostatic latent image on the photoconductor 1, a pre-transfer charger 7, a transfer charger 10, a separating charger 11, a separating pick 12, a pre-cleaning charger 13, a cleaning brush 14, and a cleaning blade 15. In addition, a pair of registration rollers 8 are provided to feed a receiving sheet 9 to the space between the photoconductor 1 and the transfer charger 10 (and the separating charger 11). The photoconductor 1 is configured to rotate in the counterclockwise direction.

Suitable charging devices for use as the charger 3, pre-transfer charger 7, transfer charger 10, separating charger 11, and pre-cleaning charger 13 include known charging devices such as corotrons, scorotrons, solid state chargers and charging rollers. Any known charging devices can be used as the transfer charger 10. However, the transfer device as shown in FIG. 1 (i.e., a combination of the transfer charger 10 with the separating charger 11) is preferable. Suitable light sources for use in the imagewise light exposing device 5 and the discharging lamp 2 include fluorescent lamps, tungsten lamps, halogen lamps, mercury lamps, sodium lamps, light emitting diodes (LEDs), laser diodes (LDs) and light sources using electroluminescence (EL). In addition, in order to emit light having a desired wave length range, filters such as sharp-cut filters, band pass filters, near-infrared cutting filters, dichroic filters, interference filters, color temperature converting filters and the like can be used. These light sources can also be used for the image transfer process, discharging process, and cleaning process, and a pre-exposure process which is optionally performed, if it is needed to irradiate the photoreceptor 1 with light in the processes.

The surface of the photoconductor 1 is charged with the charger 3. The photoconductor 1 is exposed to imagewise light emitted by the imagewise light exposing device 5, so that an electrostatic latent image is formed on the photoconductor 1. The electrostatic latent image is then developed with a toner on a developing roller 61 in the developing device 6 to form a toner image on the photoconductor 1. The toner image is charged with the pre-transfer charger 7 to have a charge suitable for transferring. The toner image is then transferred onto the receiving sheet 9 while the receiving sheet 9 is charged with the transfer charger 10. The receiving sheet 9 is then charged with the separating charger 11 to facilitate separation from the photoconductor 1 by being released from the state in which the receiving sheet 9 and the photoconductor 1 are electrostatically adhered to each other. The receiving sheet 9 is then separated from the photoconductor 1 with the separating pick 12. After the toner image transferring process, the surface of the photoconductor 1 is cleaned using the pre-cleaning charger 13, the fur brush 14 and the cleaning blade 15. If desired, the cleaning process may be performed only by a cleaning brush. Suitable cleaning brushes include fur brushes and magnetic fur brushes.

In charging process, the photoconductor 1 may be charged positively or negatively. When a latent image having a positive (negative) charge is developed with a toner having a negative (positive) charge, a positive image (i.e., the same image as the latent image) can be obtained. In contrast, when a latent image having a positive (negative) charge is developed with a toner having a positive (negative) charge, a negative image (i.e., a reversal image) can be obtained. As the developing method, known developing methods can be used. In addition, as the discharging methods, known discharging methods can also be used.

The above-mentioned image forming units as shown in FIG. 1 can be fixedly incorporated in image forming apparatuses such as copying machines, facsimile machines, printers and the like. Alternatively, the image forming units can be set in an image forming apparatus in the form of a process cartridge. The process cartridge is, for example, a cartridge which includes a photoconductor and at least one device selected from a charger, a light exposing device, a developing device, a transfer device, a cleaning device, and a discharging device.

Figure 2:
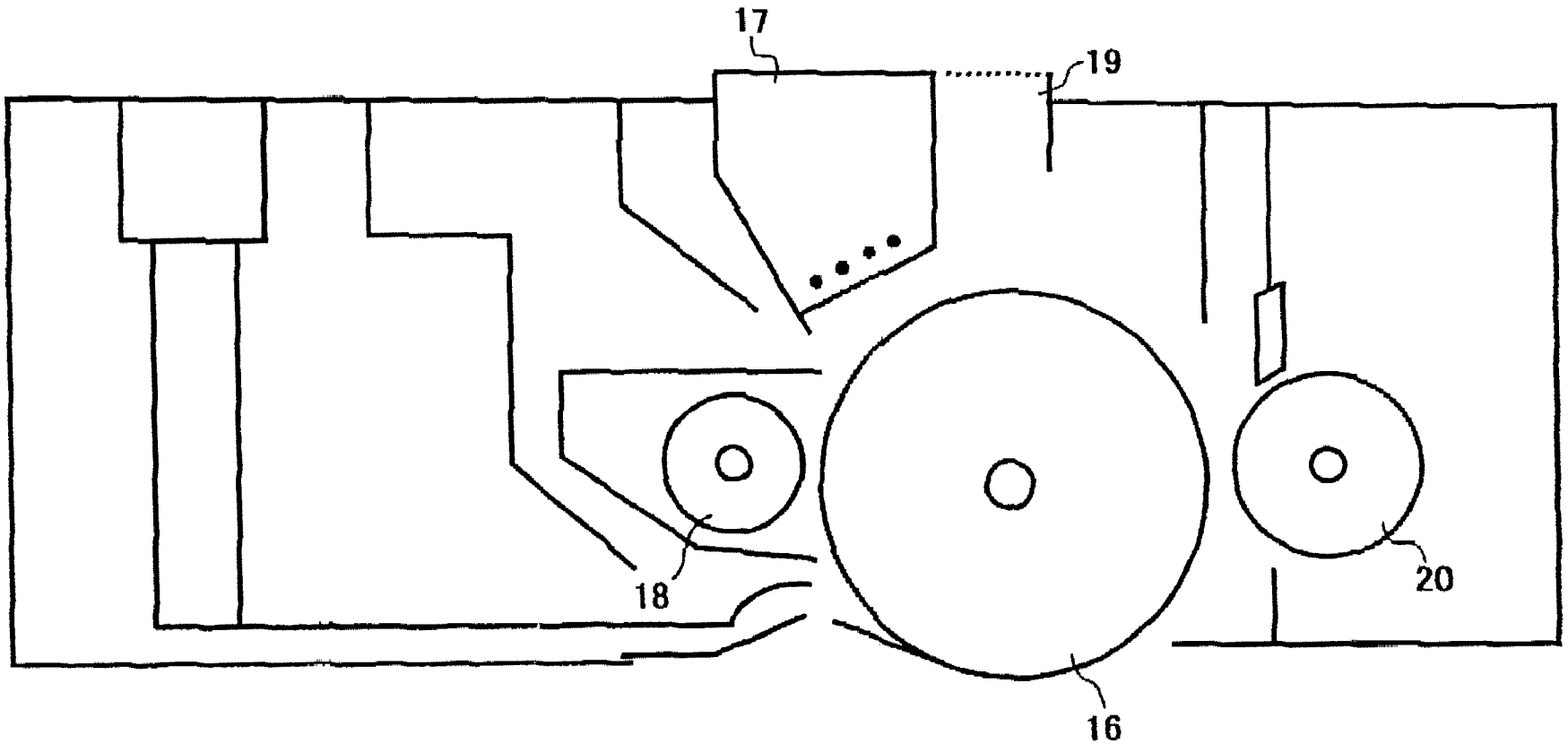
FIG. 2 is a schematic view showing an example of a process cartridge according to the present invention.

FIG. 2 illustrates one embodiment of the process cartridge of the present invention. As shown in FIG. 2, a photoconductor 16, a charger 17, a developing roller 19 and a cleaning brush 20 are provided in a housing. The photoconductor 16 is charged with the charger 17 and exposed to light emitted by an imagewise light exposing device to form an electrostatic latent image thereon. The latent image is developed with a toner on the developing roller 19 to form a toner image. The toner image is transferred on a receiving material (not shown). The surface of the photoconductor is cleaned by the cleaning brush 20.

The following examples will further illustrate the present invention. Parts are by weight.

Synthesis Example 1

Synthesis of Epoxy Group-Containing Amine Compound

In a reactor equipped with a stirrer, a thermometer, a dropping funnel and a reflux condenser provided with a trap to remove water formed during the reaction, 19.34 g (40.0 mmol) of 4-[2,2-bis(4-hydroxyphenyl)vinyl]phenyl-bis(4-methylphenyl)amine and 37.01 g (400.0 mmol) of epichlorohydrin are charged. The mixture was heated to 110° C. with stirring under a nitrogen gas stream. Then, while maintaining the mixture in the reactor at 100 to 120° C., 19.20 g (96.0 mmol) of a 10% by weight aqueous solution of sodium hydroxide were added dropwise to the mixture through 3 hours. During the reaction, epichlorohydrin emitted overhead from the reactor was condensed and returned to the reactor, while water was trapped and discharged from the system. After the addition of the sodium hydroxide solution had been completed, the reaction mixture was further reacted for 1 hour at 110° C. The resulting reaction mixture was allowed to cool to room temperature and epichlorohydrin was removed in vacuo. The remaining mixture was mixed with toluene and the organic layer was washed with water. The washed organic layer was then dried with anhydrous magnesium sulfate. The toluene was removed by distillation in vacuo to leave 20.75 g of a yellow crude product with a yield of 87.1%. The melting point of the crude product was in the range of 111.0 to 116.0° C. This was purified by column chromatography using a toluene/ethyl acetate (20/1 vol/vol) elution liquid and then recrystallized from ethyl acetate and ethanol to obtain 15.85 g (yield 66.5%) of an epoxy group-containing amine compound of the formula shown below as light yellow needle crystals having a melting point of 128.0-129.0° C.

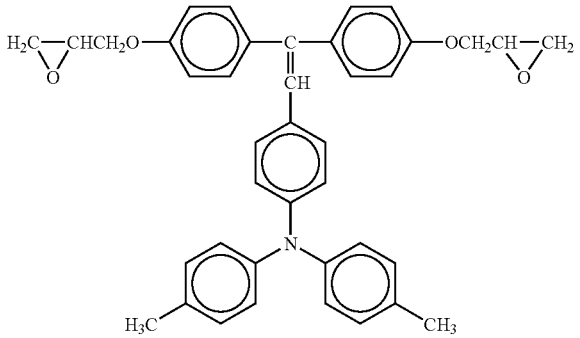

The IR absorption spectrum (NaCl liquid film) of the product was as summarized in Table 1. The elementary analysis gave as follows.

| | C | H | N |
|---|---|---|---|
| measured: | 80.80 | 6.33 | 2.37 |
| calculated: | 80.65 | 6.26 | 2.35 |

TABLE 1

| Peak No. | Wave Number ($cm^{-1}$) | Transmittance (%) |
|---|---|---|
| 1 | 3585.2 | 86.6961 |
| 2 | 3025.78 | 77.3751 |
| 3 | 3000.69 | 78.4534 |
| 4 | 2921.63 | 76.9159 |
| 5 | 2871.49 | 82.2575 |
| 6 | 1899.54 | 86.7041 |
| 7 | 1600.63 | 50.3127 |
| 8 | 1573.63 | 77.7945 |
| 9 | 1506.13 | 17.2425 |
| 10 | 1454.06 | 76.0974 |
| 11 | 1415.49 | 79.7039 |
| 12 | 1376.93 | 81.8354 |
| 13 | 1344.14 | 80.3811 |
| 14 | 1321.00 | 53.3842 |
| 15 | 1294.00 | 53.0009 |
| 16 | 1278.57 | 50.7674 |
| 17 | 1241.93 | 44.2706 |
| 18 | 1178.29 | 61.4308 |
| 19 | 1132.01 | 81.0636 |
| 20 | 1108.87 | 76.6790 |
| 21 | 1078.01 | 83.8241 |
| 22 | 1035.59 | 63.6697 |
| 23 | 970.019 | 83.2446 |
| 24 | 916.022 | 75.4043 |
| 25 | 862.025 | 77.7342 |
| 26 | 835.026 | 60.4030 |
| 27 | 815.742 | 57.3333 |
| 28 | 765.601 | 80.0271 |
| 29 | 736.674 | 78.7032 |
| 30 | 715.461 | 76.4214 |
| 31 | 659.536 | 76.4833 |
| 32 | 611.324 | 59.9646 |
| 33 | 451.261 | 2.62751 |
| 34 | 430.048 | 1.46642 |

Example 1

An undercoat layer coating liquid, a charge generating layer coating liquid and a charge transporting layer coating liquid, which had the compositions shown below, were coated and dried one by one to overlay an undercoat layer of 3.5 μm thick, a charge generating layer of 0.2 μm thick and a charge transporting layer of 26 μm thick on an aluminum cylinder.

[Undercoat Layer Coating Liquid]

| | |
|---|---|
| Titanium oxide | 400 parts |
| Melamine resin | 40 parts |
| Alkyd resin | 60 parts |
| 2-Butanone | 500 parts |

[Charge Generating Layer Coating Liquid]

| | |
|---|---|
| Bisazo pigment of the formula shown below | 12 parts |

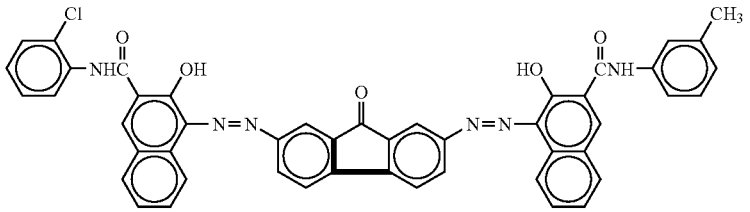

| | |
|---|---|
| Polyvinyl butyral resin | 5 parts |
| 2-Butanone | 200 parts |
| Tetrahydrofuran | 400 parts |

[Charge Transporting Layer Coating Liquid]

| | |
|---|---|
| Polycarbonate resin (Bisphenol Z-type polycarbonate resin manufactured by Teijin Kasei Inc.) | 10 parts |
| Charge transporting material having the formula shown below | 10 parts |

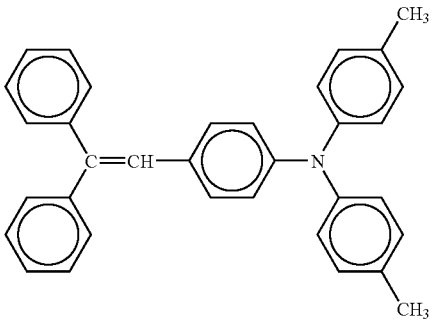

| | |
|---|---|
| Tetrahydrofuran | 100 parts |
| 1% Silicone oil tetrahydrofuran solution (KF50-100CS manufactured by Shin-etsu Chemical Industry Co., Ltd.) | 1 part |

A protective coating liquid (I) having the composition shown below was then spray-coated onto the charge transporting layer to form a protective layer having a thickness of about 3 μm and the resulting layered assembly was heated at 120° C. for 2 hours, thereby obtaining an electrophotographic photoconductor of the present invention.

[Protective Layer Coating Liquid (I)]

| | |
|---|---|
| Epoxy group-containing amine compound obtained in Synthesis Example 1 above | 4.2 parts |
| Methyltrimethoxysilane | 5 parts |
| Phenyltriethoxysilane | 5 parts |
| 1% Aqueous acetic acid solution | 5.57 parts |
| Tetrahydrofuran | 30.7 parts |
| n-Butanol | 3.67 parts |

Example 2

A precursor liquid for a protective layer coating liquid having the following formulation was prepared:

[Precursor]

| | |
|---|---|
| Methyltrimethoxysilane | 5 parts |
| Phenyltriethoxysilane | 5 parts |
| 1% Aqueous acetic acid solution | 5.57 parts |
| Tetrahydrofuran | 30.7 parts |
| n-Butanol | 3.67 parts |

The precursor liquid was then heated at 60° C. for 2 hours with stirring for silanolizing the methyltrimethoxysilane and phenyltriethoxysilane by hydrolysis. The resulting liquid was mixed with 4.2 parts of the epoxy group-containing amine compound obtained in Synthesis Example 1 above to obtain a protective layer coating liquid (II). An electrophotographic photoconductor was then prepared in the same manner as that in Example 1 except that the protective layer coating liquid (II) was substituted for the protective layer coating liquid (I).

Example 3

To a mixture composed of 21 parts of methyltrimethoxysilane and 21 parts of phenyltriethoxysilane, 8.16 parts of a 1% aqueous acetic acid solution were added through 25 minutes in an ice bath. The mixture was stirred at 5° C. for 30 minutes and then stirred at 24° C. for 2 hours for silanolizing the methyltrimethoxysilane and phenyltriethoxysilane by hydrolysis, thereby obtaining a hydrolyzed liquid.

A protective layer coating liquid (III) having the formulation shown below was prepared.

[Protective Layer Coating Liquid (III)]

| | |
|---|---|
| Hydrolyzed liquid obtained above | 3 parts |
| Epoxy group-containing amine compound obtained in Synthesis Example 1 above | 0.98 part |
| 2-methoxyethyl acetate | 2.62 parts |
| Cyclohexanone | 2.42 parts |
| Tetrahydrofuran | 0.98 part |
| Acetylacetone | 0.12 part |
| Aluminum acetylacetonate | 0.12 part |

An electrophotographic photoconductor was then prepared in the same manner as that in Example 1 except that the protective layer coating liquid (III) was substituted for the protective layer coating liquid (I) and that the application of the surface protective layer coating liquid (III) was carried out by ring coating.

Example 4

To a mixture composed of 21 parts of methyltrimethoxysilane and 21 parts of phenyltriethoxysilane, 8.16 parts of a 1% aqueous acetic acid solution were added through 25 minutes in an ice bath. The mixture was stirred at 5° C. for 30 minutes and then stirred at 24° C. for 2 hours for silanolizing the methyltrimethoxysilane and phenyltriethoxysilane by hydrolysis, thereby obtaining a hydrolyzed liquid.

A protective layer coating liquid (IV) having the formulation shown below was prepared.

[Protective Layer Coating Liquid (IV)]

| | |
|---|---|
| Hydrolyzed liquid obtained above | 2.17 parts |
| Epoxy group-containing amine compound obtained in Synthesis Example 1 above | 0.98 part |
| Colloidal silica (average particle diameter: 20 nm) dispersed in n-propylcellosolve | 2.32 parts |
| 2-methoxyethyl acetate | 1.9 parts |
| Cyclohexanone | 1.63 parts |
| Tetrahydrofuran | 0.98 part |
| Acetylacetone | 0.09 part |
| Aluminum acetylacetonate | 0.09 part |

An electrophotographic photoconductor was then prepared in the same manner as that in Example 1 except that the surface protective layer coating liquid (IV) was substituted for the protective layer coating liquid (I), that the application of the surface protective layer coating liquid (IV) was carried out by ring coating, that the applied coating of the surface protective layer coating liquid (IV) was allowed to stand at room temperature for 30 minutes and the resulting layered assembly was then heated at 130° C. for 1 hour, and that the thickness of the surface protective layer was 2 μm.

Comparative Example 1

An electrophotographic photoconductor was prepared in the same manner as that in Example 1 except that the epoxy group-containing amine compound obtained in Synthesis Example 1 was replaced by a hydroxyl group-containing amine compound of the formula shown below.

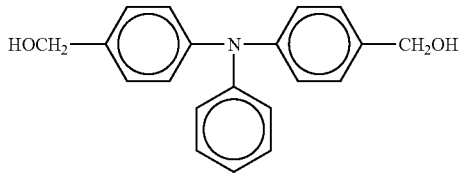

Comparative Example 2

An electrophotographic photoconductor was prepared in the same manner as that in Example 1 except that the protective layer was not provided on the charge transporting layer.

Example 5

An undercoat layer coating liquid, a charge generating layer coating liquid and a charge transporting layer coating liquid, which had the compositions shown below, were coated and dried one by one to overlay an undercoat layer of 3.5 μm thick, a charge generating layer of 0.2 μm thick and a charge transporting layer of 26 μm thick on an aluminum cylinder.

[Undercoat Layer Coating Liquid]

| | |
|---|---|
| Titanium oxide | 400 parts |
| Melamine resin | 40 parts |
| Alkyd resin | 60 parts |
| 2-Butanone | 500 parts |

[Charge Generating Layer Coating Liquid]

| | |
|---|---|
| Bisazo pigment of the formula shown below | 12 parts |

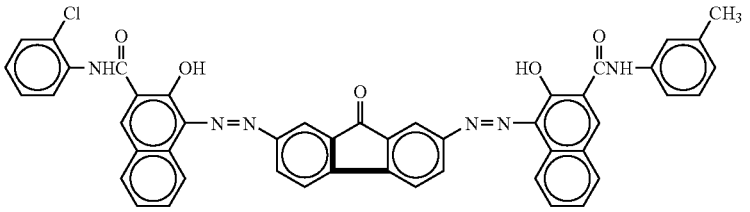

| | |
|---|---|
| Polyvinyl butyral resin | 5 parts |
| 2-Butanone | 200 parts |
| Tetrahydrofuran | 400 parts |

[Charge Transporting Layer Coating Liquid]

| | |
|---|---|
| Polycarbonate resin (Bisphenol Z-type polycarbonate resin manufactured by Teijin Kasei Inc.) | 10 parts |
| Charge transporting material having the formula shown below | 10 parts |

-continued

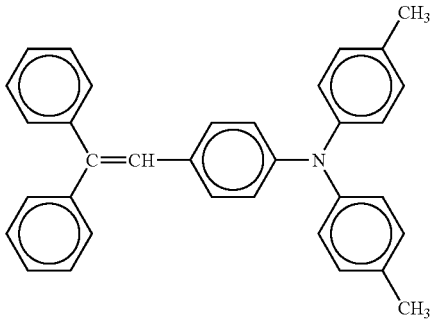

| | |
|---|---|
| Tetrahydrofuran | 100 parts |
| 1% Silicone oil tetrahydrofuran solution (KF50-100CS manufactured by Shin-etsu Chemical Industry Co., Ltd.) | 1 part |

A protective coating liquid (V) having the composition shown below was then spray-coated onto the charge transporting layer to form a protective layer having a thickness of about 3 μm and the resulting layered assembly was heated at 120° C. for 2 hours, thereby obtaining an electrophotographic photoconductor of the present invention.

[Protective Layer Coating Liquid (V)]

| | |
|---|---|
| Epoxy group-containing amine compound obtained in Synthesis Example 1 above | 35 parts |
| 3-Glysidoxypropyltrimethoxysilane | 13 parts |
| Methyltrimethoxysilane | 45 parts |
| Phenyltriethoxysilane | 32 parts |
| 1% Aqueous acetic acid solution | 37.6 parts |
| Boron trifluoride triethylamine salt | 0.5 part |
| Tetrahydrofuran | 248.4 parts |
| n-Butanol | 27.6 parts |

Example 6

A precursor liquid for a protective layer coating liquid having the following formulation was prepared:

[Precursor]

| | |
|---|---|
| 3-Glysidoxypropyltrimethoxysilane | 13 parts |
| Methyltrimethoxysilane | 45 parts |
| Phenyltriethoxysilane | 32 parts |
| 1% Aqueous acetic acid solution | 37.6 parts |
| Tetrahydrofuran | 248.4 parts |
| n-Butanol | 27.6 parts |

The precursor liquid was then heated at 60° C. for 2 hours with stirring for silanolizing the 3-glysidoxypropyltrimethoxysilane, methyltrimethoxysilane and phenyltriethoxysilane by hydrolysis. The resulting liquid was mixed with 35 parts of the epoxy group-containing amine compound obtained in Synthesis Example 1 above and 0.5 part of boron trifluoride triethylamine salt to obtain a protective layer coating liquid (VI). An electrophotographic photoconductor was then prepared in the same manner as that in Example 5 except that the protective layer coating liquid (VI) was substituted for the protective layer coating liquid (V).

Example 7

To 42 parts of glysidoxypropyltrimethoxysilane, 8.16 parts of a 1% aqueous acetic acid solution were added through 25 minutes in an ice bath. The mixture was stirred at 5° C. for 30 minutes and then stirred at 24° C. for 2 hours for silanolizing the glysidoxypropyltrimethoxysilane by hydrolysis, thereby obtaining a hydrolyzed liquid.

A protective layer coating liquid (VII) having the formulation shown below was prepared.

[Protective Layer Coating Liquid (VII)]

| | |
|---|---|
| Hydrolyzed liquid obtained above | 3 parts |
| Epoxy group-containing amine compound obtained in Synthesis Example 1 above | 0.98 part |
| 2-methoxyethyl acetate | 2.62 parts |
| Cyclohexanone | 2.42 parts |
| Tetrahydrofuran | 0.98 part |
| Acetylacetone | 0.12 part |
| Aluminum acetylacetonate | 0.12 part |

An electrophotographic photoconductor was then prepared in the same manner as that in Example 5 except that the protective layer coating liquid (VII) was substituted for the protective layer coating liquid (V) and that the application of the surface protective layer coating liquid (VII) was carried out by ring coating.

Example 8

To 42 parts of glysidoxypropyltrimethoxysilane, 8.16 parts of a 1% aqueous acetic acid solution were added through 25 minutes in an ice bath. The mixture was stirred at 5° C. for 30 minutes and then stirred at 24° C. for 2 hours for silanolizing the glysidoxypropyltrimethoxysilane by hydrolysis, thereby obtaining a hydrolyzed liquid.

A protective layer coating liquid (VIII) having the formulation shown below was prepared.

[Protective Layer Coating Liquid (VIII)]

| | |
|---|---|
| Hydrolyzed liquid obtained above | 2.17 parts |
| Epoxy group-containing amine compound obtained in Synthesis Example 1 above | 0.98 part |
| Colloidal silica (average particle diameter: 20 nm) dispersed in n-propylcellosolve | 2.32 parts |
| 2-methoxyethyl acetate | 1.9 parts |
| Cyclohexanone | 1.63 parts |
| Tetrahydrofuran | 0.98 part |
| Acetylacetone | 0.09 part |
| Aluminum acetylacetonate | 0.09 part |

An electrophotographic photoconductor was then prepared in the same manner as that in Example 5 except that the surface protective layer coating liquid (VIII) was substituted for the protective layer coating liquid (V), that the application of the surface protective layer coating liquid (VIII) was carried out by ring coating, that the applied coating of the surface protective layer coating liquid (VIII) was allowed to stand at room temperature for 30 minutes and the resulting layered assembly was then heated at 130° C. for 1 hour, and that the thickness of the surface protective layer was 4 μm.

Comparative Example 3

An electrophotographic photoconductor was prepared in the same manner as that in Example 5 except that the epoxy group-containing amine compound obtained in Synthesis Example 1 was replaced by a hydroxyl group-containing amine compound of the formula shown below.

[Protective Layer Coating Liquid (IV)]

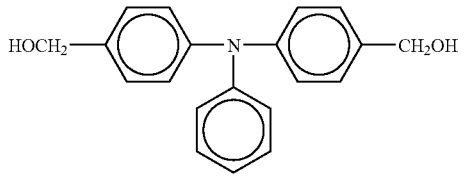

Comparative Example 4

An electrophotographic photoconductor was prepared in the same manner as that in Example 5 except that the following protective layer coating liquid (IX) was substituted for the protective layer coating liquid (V):

| | |
|---|---|
| Hydroxyl group-containing amine compound of the formula shown below | 7 parts |
| 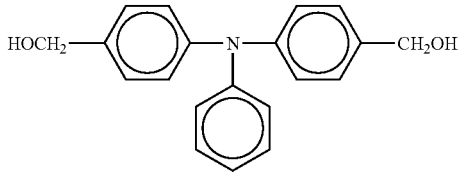 | |
| Methyltrimethoxysilane | 18 parts |
| 1% Aqueous acetic acid solution | 10 parts |
| n-Butanol | 55.1 parts |

Each of the electrophotographic photoconductors obtained in Examples 1-8 and Comparative Examples 1-4 was mounted on an image forming machine (imagio MF2200 manufactured by Ricoh Company, Ltd.; modified by using 655 nm laser diode as a light source). The machine was continuously operated to produce 10,000 copies. Thereafter, the photoconductor was measured for a change of the thickness of the protective layer and observed by a microscope to check the formation of scratch. Further, the potential (VD) of the dark area and the potential (VL) of the lighted area of each of the photoreceptors before and after the production of 10,000 copies were measured, from which a change in VD (ΔVD) and a change in VL (ΔVL) were calculated. In addition, a test chart was copied to evaluate the image quality. Also conducted a test for formation of cracks. Thus, the photoconductor was toughed with a finger to impress a finger print thereonto. Whether or not cracks were formed was examined 48 hours after the impression of the finger print. The evaluation of the results of surface observation, image quality and crack formation were rated as follows:

Surface Observation:

A: only fine line scratches are observed

B: small cavities are locally observed

C: small cavities are observed in entire surface of the protective layer, or a part of the protective layer falls off Image Quality:

A: no image defects are observed

B: background stains, white resolution are partly observed

C: reduction of image density, background stains, white spots and/or reduced resolution are observed in entire surface Formation of Cracks:

A: no cracks are observed

B: cracks are locally observed

C: cracks are formed in entire surface

The results are shown in Table 2.

TABLE 2

| Example No. | Reduction of Thickness (μm) | Surface Observation | ΔVD (V) | ΔVL (V) | Image Quality | Formation of Cracks |
|---|---|---|---|---|---|---|
| 1 | 2.9 | A | −30 | +20 | A | A |
| 2 | 2.7 | A | −30 | +20 | A | A |
| 3 | 0.80 | A | −30 | +10 | A | A |
| 4 | 0.65 | A | −20 | +20 | A | A |
| 5 | 2.9 | A | −30 | +20 | A | A |
| 6 | 2.8 | A | −30 | +20 | A | A |
| 7 | 0.7 | A | −30 | +10 | A | A |
| 8 | 0.5 | A | −20 | +20 | A | A |
| Comp. 1 | 6.1 | C | −50 | +30 | B | A |
| Comp. 2 | 5.5 | B | −10 | +10 | B | C |
| Comp. 3 | 6.2 | C | −50 | +30 | B | A |
| Comp. 4 | 6.0 | C | −50 | +30 | B | A |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. An electrophotographic photoconductor comprising a layer comprising a crosslinked silicone resin comprising a group of the formula:

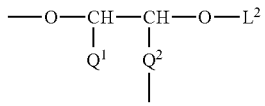

bonded to silicon atoms of said resin, wherein $Q^1$ represents a hydrogen atom and $Q^2$ represents an oxyalkylene group or an alkylene group, or $Q^1$ and $Q^2$ are taken in combination to represent a cycloalkylene group or a cycloalkylenealkylene group and $L^2$ represents a hydrogen atom or a bond connected to a silicon atom of said resin, and —[O—$CH_2$—CH($OL^1$)-]$_p$Z groups bonded to silicon atoms of the resin, wherein Z represents a charge transferability-imparting group of the formula:

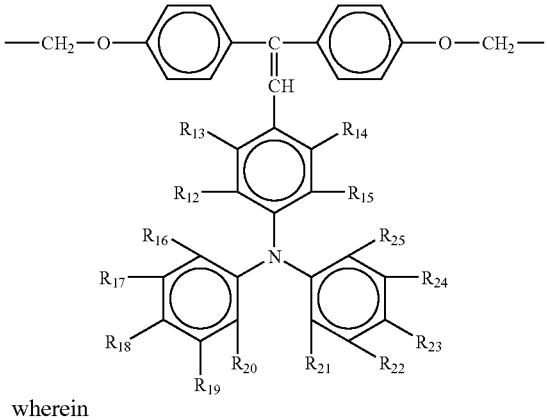

wherein $R_{12}$ to $R_{25}$ are the same or different and selected from the group consisting of hydrogen, a halogen, and an alkyl group;

$L^1$ represents a hydrogen atom or a bond connected to a silicon atom of the resin and p is 2.

2. An electrophotographic photoconductor as claimed in claim 1, wherein $Q^1$ represents a hydrogen atom and $Q^2$ represents an oxyalkylene group.

3. An electrophotographic photoconductor as claimed in claim 1, wherein $Q^1$ represents a hydrogen atom and $Q^2$ represents an alkylene group.

4. An electrophotographic photoconductor as claimed in claim 1, wherein $Q^1$ and $Q^2$ are taken in combination to represent a cycloalkylene group.

5. An electrophotographic photoconductor as claimed in claim 1, wherein $Q^1$ and $Q^2$ are taken in combination to represent a cycloalkylenealkylene group.

6. An electrophotographic photoconductor as claimed in claim 1, wherein $L^2$ represents a hydrogen atom.

7. An electrophotographic photoconductor as claimed in claim 1, wherein $L^2$ represents a bond connected to a silicon atom of said resin.

8. An electrophotographic photoconductor as claimed in claim 1, wherein $L^1$ represents a hydrogen atom.

9. An electrophotographic photoconductor as claimed in claim 1, wherein $L^1$ represents a bond connected to a silicon atom of the resin.

* * * * *